US006878005B2

(12) United States Patent
Varone et al.

(10) Patent No.: US 6,878,005 B2
(45) Date of Patent: Apr. 12, 2005

(54) MODULE AND CONNECTOR LATCH

(75) Inventors: John J. Varone, Seekonk, MA (US); Herbert McEvoy, N. Attleboro, MA (US)

(73) Assignee: Helix Technology Corporation, Mansfield, MA (US)

( * ) Notice: Subject to any disclaimer, the term of this patent is extended or adjusted under 35 U.S.C. 154(b) by 522 days.

(21) Appl. No.: 09/821,830

(22) Filed: Mar. 29, 2001

(65) Prior Publication Data

US 2002/0098731 A1 Jul. 25, 2002

Related U.S. Application Data

(60) Provisional application No. 60/263,168, filed on Jan. 22, 2001.

(51) Int. Cl.[7] ..... H01R 13/625

(52) U.S. Cl. ..... 439/347; 439/376; 439/545; 439/304

(58) Field of Search ..... 439/347, 911, 439/545, 300, 299, 376, 304; 361/726, 725, 727

(56) References Cited

U.S. PATENT DOCUMENTS

| | | | | |
|---|---|---|---|---|
| 4,387,956 A | | 6/1983 | Cline | 350/96.2 |
| 4,583,803 A | | 4/1986 | Bringuel | 339/45 M |
| 4,590,540 A | | 5/1986 | Nicholson et al. | 361/400 |
| 4,846,708 A | | 7/1989 | Marson et al. | 439/133 |
| 5,169,332 A | | 12/1992 | Cooke et al. | 439/304 |
| 5,288,241 A | | 2/1994 | Davidge et al. | 439/304 |
| 5,340,324 A | | 8/1994 | Fields et al. | 439/133 |
| 5,385,484 A | | 1/1995 | Bartle et al. | 439/468 |
| 5,685,730 A | | 11/1997 | Cameron et al. | 439/335 |
| 5,855,491 A | | 1/1999 | Hintner et al. | 439/409 |
| 5,876,244 A | | 3/1999 | Tabata | 439/521 |
| 5,879,173 A | | 3/1999 | Poplawski et al. | 438/138 |
| 5,949,652 A | | 9/1999 | McAnally et al. | 361/726 |
| 5,964,611 A | | 10/1999 | Jacob et al. | 439/372 |
| 6,038,125 A | | 3/2000 | Anzai | 361/609 |
| 6,044,551 A | * | 4/2000 | Jarrett | 29/868 |
| 6,053,756 A | | 4/2000 | Flanigan et al. | 439/315 |

* cited by examiner

*Primary Examiner*—Neil Abrams
(74) *Attorney, Agent, or Firm*—Hamilton, Brook, Smith & Reynolds, P.C.

(57) ABSTRACT

A securing mechanism includes a connector latch and a module latch such that engagement of the connector latch with a connector causes the module latch to engage a housing support. The securing mechanism prevents removal of a module from a housing support when a connector, such as on a power cable, is engaged by the connector latch. The connector latch has a position adjustment mechanism, engageable by an external tool, that controls the position of the connector latch. A tool is used to position the connector latch and allow the insertion or removal of the connector.

45 Claims, 22 Drawing Sheets

MODULE AND CONNECTOR LATCH

RELATED APPLICATION

This application claims the benefit of U.S. Provisional Application No. 60/263,168, filed on Jan. 22, 2001. The entire teachings of the above application are incorporated herein by reference.

BACKGROUND OF THE INVENTION

Many products are designed to include modules that can be removed from a main housing for service or replacement. Cables, in particular power cables, attach into such modules. In order to remove the module from the main housing for service, the power cable should first be removed from the module as a safety precaution. Failure to remove the power cable from the module prior to removal of the module from the main housing exposes service personnel to dangerous voltage levels carried by the cables.

Underwriter's Laboratories (UL) requires power cables be secured to their respective modules in a manner that requires a tool to remove the cable from the module. By requiring a tool for removal of the power cable from the module, inadvertent removal of the power cable is prevented.

SUMMARY OF THE INVENTION

An embodiment of the present invention includes a securing mechanism having a housing with a connector latch and a module latch moveably mounted within the housing. The connector latch is engageable with a connector, as on a power cable, to secure the connector while the module latch is engageable with a housing support. Engagement of the connector latch with the connector causes the module latch to engage the housing support.

The securing mechanism prevents removal of a module and attached connector from a housing support without a user first removing the connector from the module. An embodiment of the invention also relates to a method for securing a module to and removing a module from a housing support.

The connector latch includes a position adjustment mechanism that controls movement of the connector latch. A tool is required to move the position adjustment mechanism, thereby preventing inadvertent removal of a connector from the module. The housing can include a tool guide aperture to allow user access of the position adjustment mechanism. The securing mechanism also includes a tool securing mechanism, such as a slot within the housing of the securing mechanism that, after being engaged, prevents motion of the latch and prevents motion of the tool within the securing mechanism. Either the connector latch or the module latch can include a low friction surface to minimize binding of the latch within the housing. The securing mechanism also includes a biasing mechanism, such as a spring, to position the connector latch and the module latch within the housing.

The connector latch and module latch can form a single latch. The single latch includes a connector latch protrusion and a module latch protrusion. The securing mechanism can include a housing and a connector latch moveably mounted within the housing, the connector latch engageable with a connector to secure the connector. The securing mechanism can also include a housing and a module latch moveably mounted within the housing, the module latch engageable with a housing support to secure the module.

An embodiment of the invention also relates to a module having a module housing and a securing mechanism, as described. The securing mechanism is preferably affixed to the module housing.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
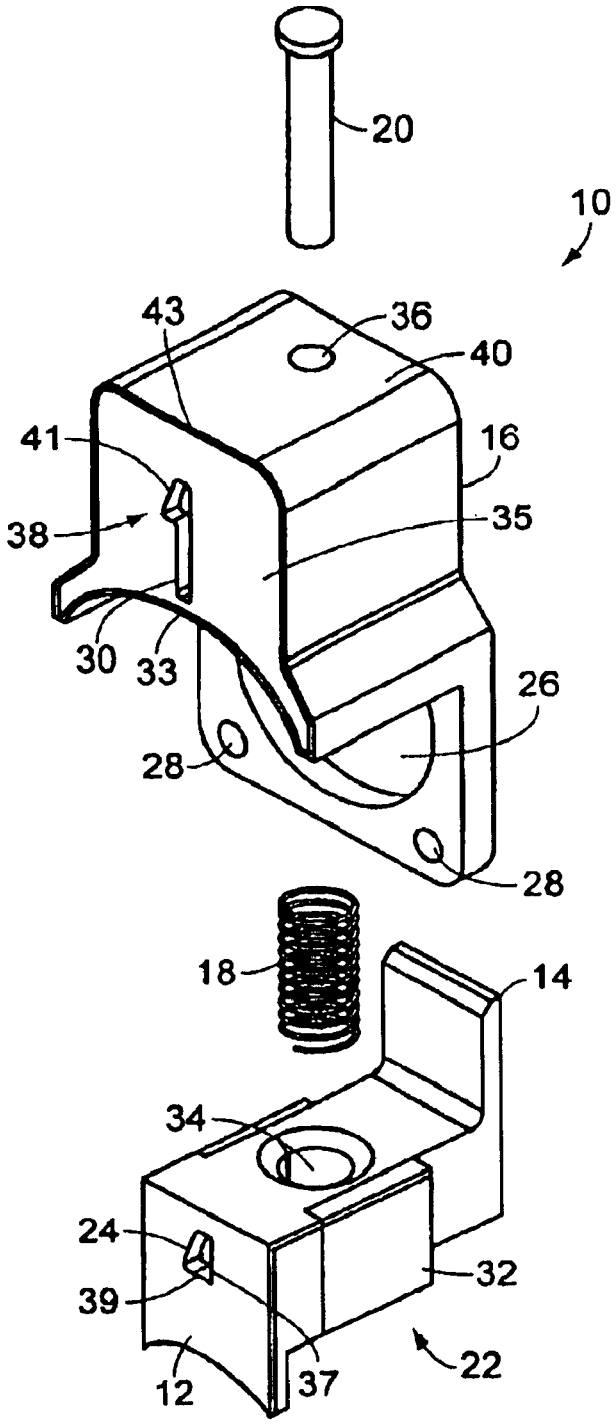
FIG. 1 illustrates an exploded view of a securing mechanism.
Figure 2A:
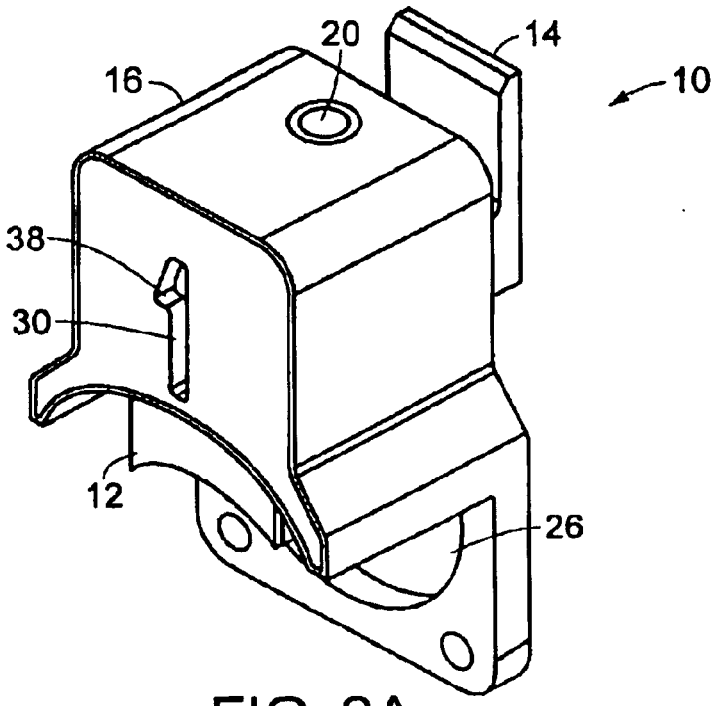
FIG. 2A illustrates a front isometric view of a securing mechanism.
Figure 2B:
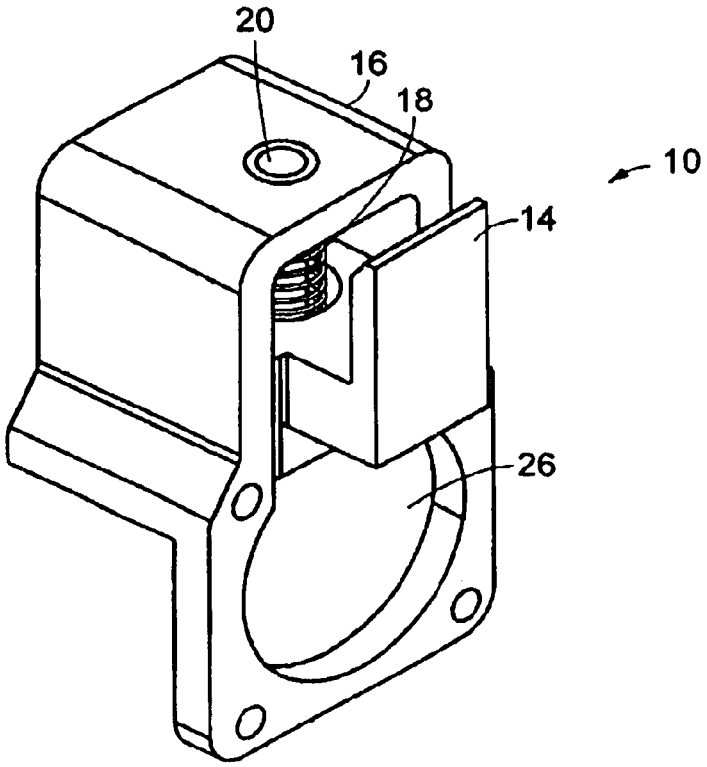
FIG. 2B illustrates a rear isometric view of a securing mechanism.
Figure 7A:
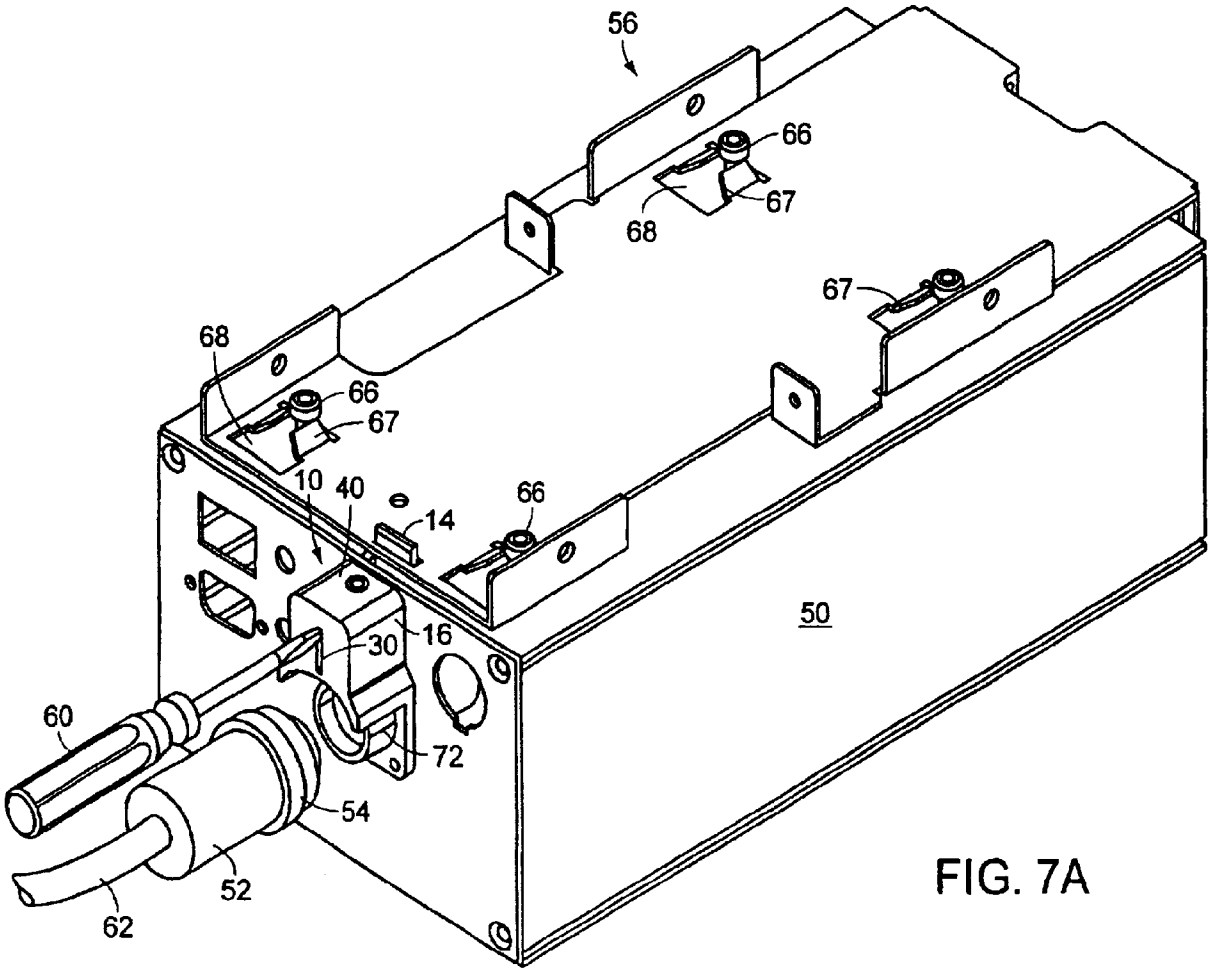
FIG. 7A illustrates an isometric view of the attachment of a connector to a module.
Figure 8A:
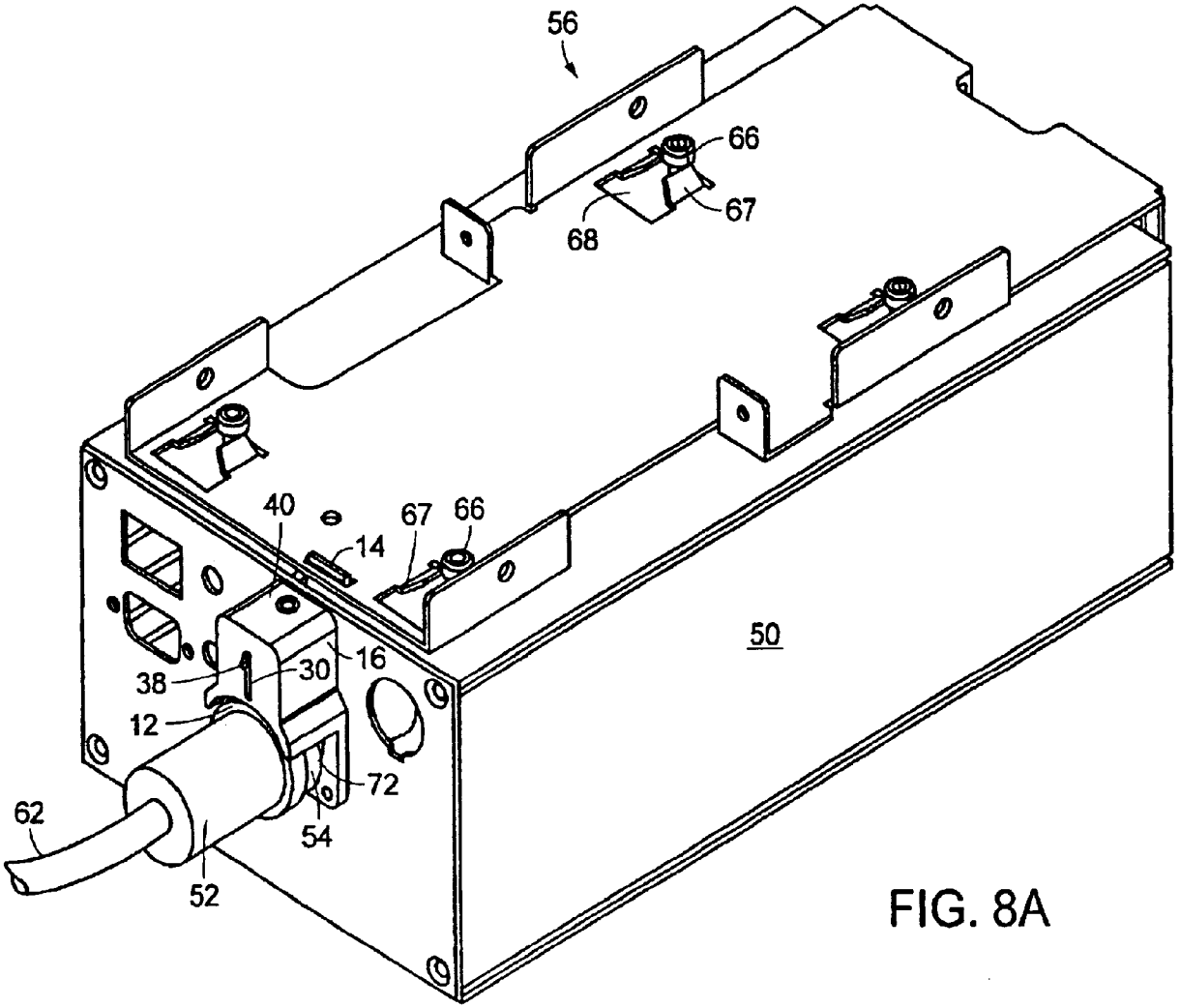
FIG. 8A illustrates an isometric view of a connector attached to a module and a module attached to a housing support.

A securing mechanism, given generally as 10, is illustrated in FIGS. 1 through 5. FIG. 1 illustrates an exploded view of the securing mechanism 10 while FIGS. 2A and 2B illustrate a front and rear perspective view of the securing mechanism 10, respectively. As shown in FIGS. 7A and 8A, the securing mechanism 10 secures a connector 52, such as on a power cable 62, to a module 50 while also securing the module 50 to a housing support 56, such as a support located on a pump, for example. To use the securing mechanism 10, a module 50 is placed next to a housing support 56. A user raises a latch of the securing mechanism 10 to provide access to module 50 by the connector 52. Raising the latch also secures the module 50 with the housing support 56. After the connector 52 is connected to the module 50, the latch is released, thereby securing the connector 52 to the module 50 and allowing the latch to remain secured to the housing support 56. In using the securing mechanism 10, after the connector 52 has been attached to the module 50 and the module 50 attached to the housing support 56, the module 50 cannot be removed from the housing support 56 without first removing the connector 52 from the securing mechanism 10.

The securing mechanism 10 includes a housing 16 and a latch 22. The housing 16 and latch 22 can be machined, molded or zinc die cast, for example. The housing 16 includes a pin 20 which is inserted through a housing aperture 36 within the housing 16. The pin 20 is secured to the housing 16 by a friction fit, adhesive or threads, for example. The pin 20, which can be formed of a plastic or stainless steel material for example, acts to guide the motion of the latch 22 within the housing 16. A connector aperture 26 and mounting or fastener apertures 28 are also located on the housing 16. The connector aperture 26 engages a mating connector 72 on a module while the fastener apertures 28 allow the securing mechanism 10 to be mounted to a module.

The latch 22 preferably includes a connector latch protrusion 12 and a module latch protrusion 14. The connector latch protrusion 12 engages a connector 52 for securing of the connector 52 to a module. The module latch protrusion 14 engages a housing support for securing of the module 50 to the housing support 56. Engagement of the connector latch protrusion 12 with a connector 52 prevents removal of the connector 52 from the module 50, to which the mechanism 10 is attached, without the use of a tool. When a connector 52 has been engaged with the connector latch protrusion 12, the module latch protrusion 14 is engaged with a housing support 56, thereby preventing the removal of the module 50 from the housing support 56.

The latch 22 can also include a low friction surface 32, shown in FIG. 1. The low friction surface 32 can be a low friction polymer such as Delrin or Teflon, for example. The low friction surface 32 allows the latch 22 to move within the housing 16 while minimizing binding, sticking or jamming of the latch 22. The securing mechanism 10 also includes a spring 18 or biasing mechanism and a latch aperture 34. The spring 18 is located between the latch 22 and an interior of the housing 16 and is positioned around the pin 20. The spring 18 biases the latch 22 away from a top surface 40 of the housing 16 and positions the cable protrusion 12 and module protrusion 14 within the housing 16. Pin 20 fits within the latch aperture 34 of the latch 22 when the latch 22 is placed within the interior of the housing 16. The pin aperture 34 allows the latch 22 to move vertically within the housing 16.

The latch 22 includes a tool insertion receptacle or position adjustment mechanism 24. The position adjustment mechanism 24 allows a user to control the positioning of the latch 22 within the housing 16. The position adjustment mechanism 24 also requires the use of a tool to install or remove a connector from the module. In one embodiment, the position adjustment mechanism 24 is triangular shaped having a height 37 of approximately 0.125 inches and abase length 39 of approximately 0.125 inches. The housing 16 includes a tool guide aperture 30 to allow a user access to the position adjustment mechanism 24. In one embodiment, the tool guide aperture 30 is a narrow slot oriented vertically with respect to the housing 16. The tool guide aperture 30 can have a width 33 of approximately 0.062 inches and a height 35 of approximately 0.45 inches. When the latch 22 is located within the housing 16, a user can place a tool through the tool guide aperture 30 and engage the position adjustment mechanism 24. The tool can be, for example, a screwdriver, a paperclip, or an awl.

The housing 16 can also include a tool securing mechanism 38. The tool securing mechanism 38 can include a notch located within the tool guide aperture 30. The tool securing mechanism 38 can include a width 43 of approximately 0.11 inches and a height 41 of approximately 0.136 inches. The tool securing mechanism 38 allows a user to secure the latch 22 in a raised position after having moved the latch 22 toward the top surface 40 of the housing 40. Such positioning of the latch 22 allows a user to engage a connector 52 to a mating connector 72 housed by the connector aperture 26 of the housing 16. The tool securing mechanism 38 also allows a user to lock the tool in a stationary position, thereby allowing the user to remove his hands from the tool to manipulate the connector and module.

Figure 3B:
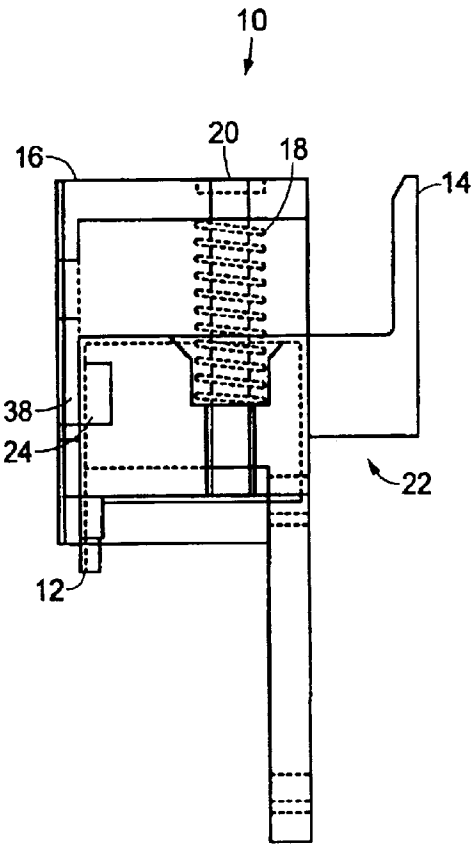
FIGS. 3A and 3B illustrate a side view and side sectional view, respectively, of a securing mechanism.
Figure 3A:
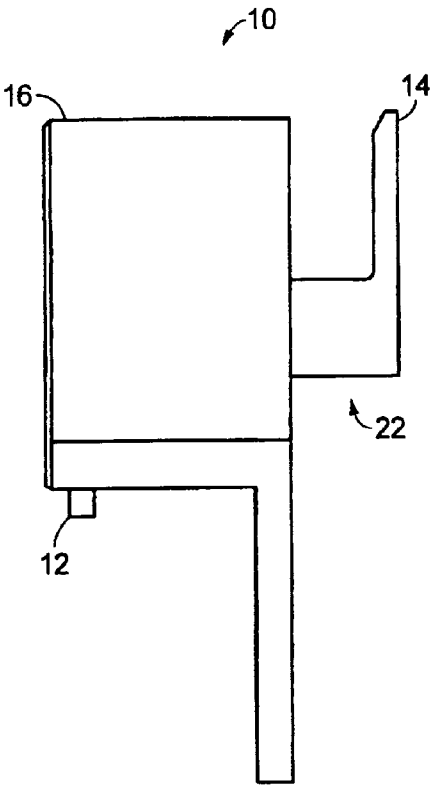
Figure 4A:
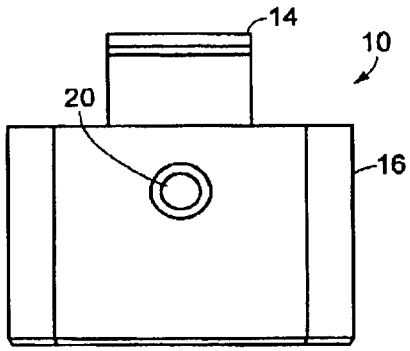
FIGS. 4A and 4B illustrate a top view and a top sectional view, respectively, of a securing mechanism.
Figure 4B:
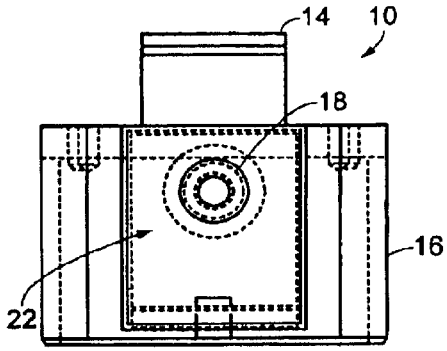
Figure 5A:
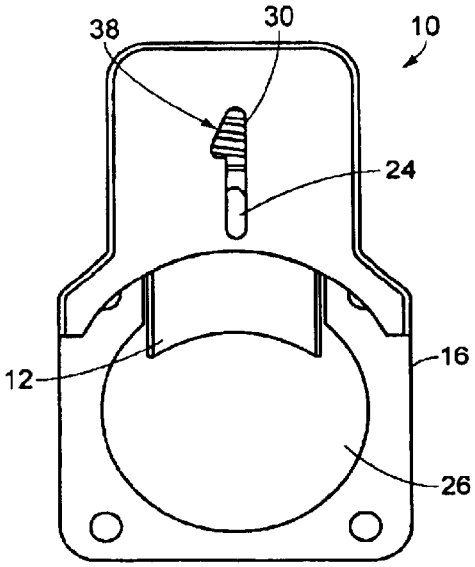
FIGS. 5A and 5B illustrate a front view and a front sectional view, respectively, of a securing mechanism.
Figure 5B:
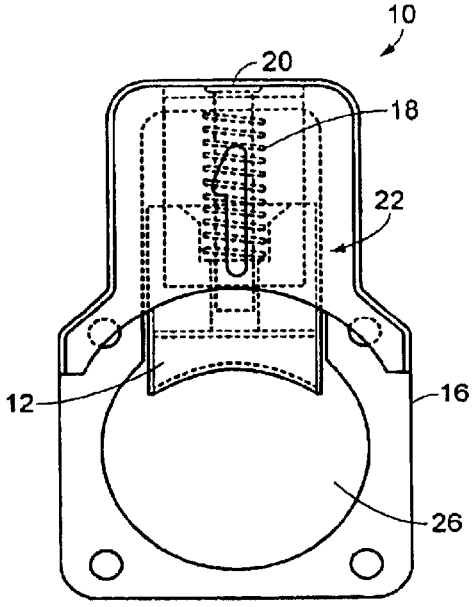

FIGS. 3, 4 and 5 illustrate the securing mechanism 10 where the latch 22 is in a neutral position, such that the module latch protrusion 14 does not engage a housing support and the biasing mechanism 18 is in a non-compressed state. When a connector 52 is introduced to the securing mechanism 10, the latch 22 is first raised from its neutral position toward a top portion 40 of the housing 16 and the connector 52 is engaged to a mating connector 72, shown in FIG. 6A, mounted within the connector aperture 26 of the housing 16. The latch 22 is raised using the position adjustment mechanism 24 and a tool. Raising the latch 22 moves the module latch protrusion 14 upward, thereby engaging the module latch protrusion 14 with a housing support. Once the connector 52 engages the mating connector 72, the user can lower the latch 22 such that the connector latch protrusion 12 engages the connector 52 and the module latch protrusion 14 remains engaged with a housing support. At this point, the biasing mechanism 18 is in a compressed state, thereby maintaining the position of the connector latch protrusion 12 and module latch protrusion 14.

Figure 6A:
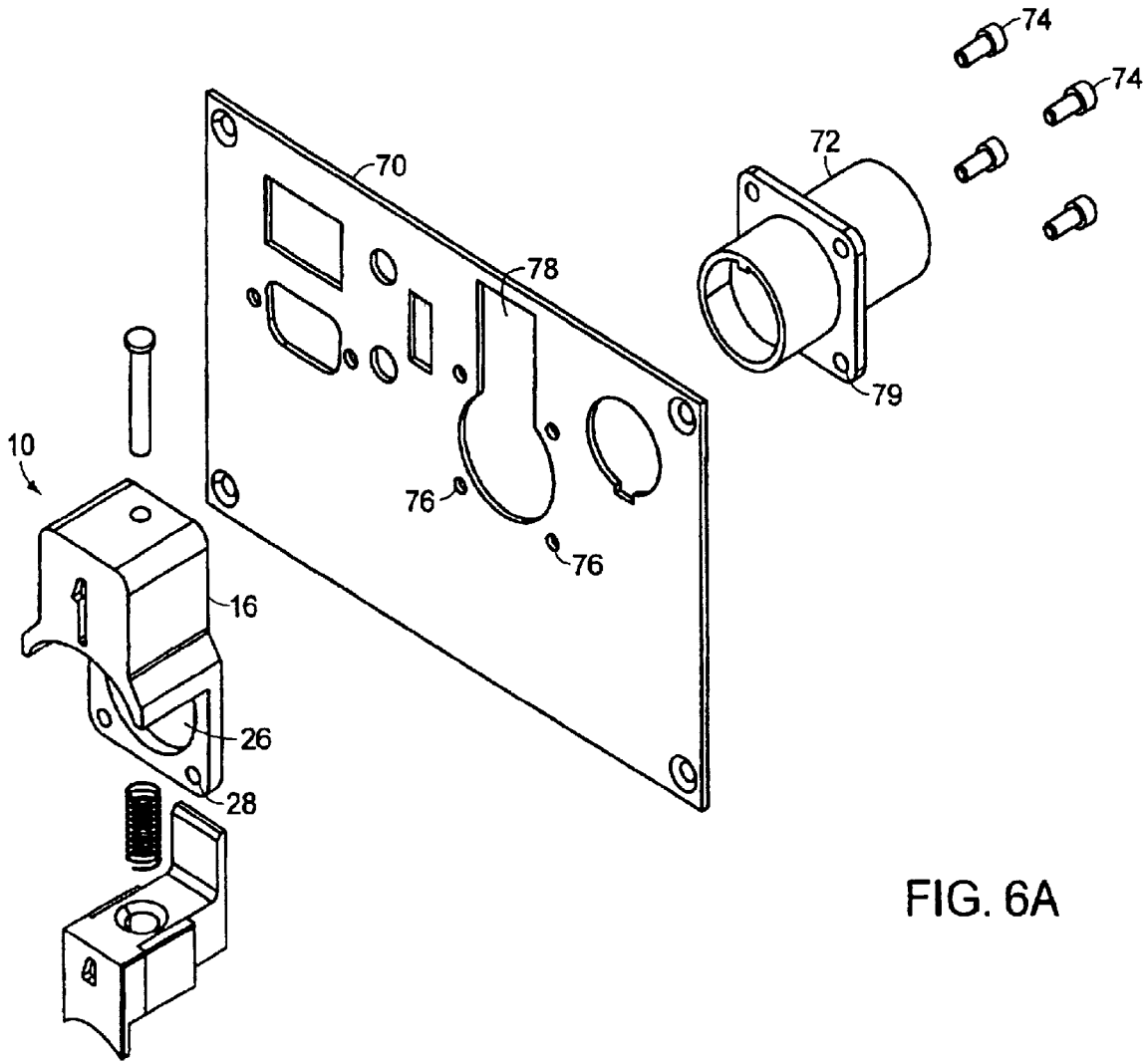
FIG. 6A illustrates an exploded view of a securing mechanism, module faceplate and mating connector.

FIG. 6A illustrates an exploded view of the securing mechanism 10, a module faceplate 70 and a mating connector 72. The housing 16 of the securing mechanism 10 includes fastener apertures 28. The securing mechanism 10 mounts to the faceplate 70 such that the mating connector 72 protrudes through a connector aperture 78 in the faceplate 70 and through the connector aperture 26 on the securing mechanism 10. The faceplate 70 includes fastener apertures 76 and the mating connector 72 includes fastener apertures 79. When the securing mechanism 10, faceplate 70 and mating connector 72 are assembled, fasteners 74, such as screws, can secure these items through the fastener apertures 79 on the mating connector 72, the fastener apertures 76 on the faceplate 70 and the fastener apertures 28 on the housing 16 of the securing mechanism 10.

Figure 6B:
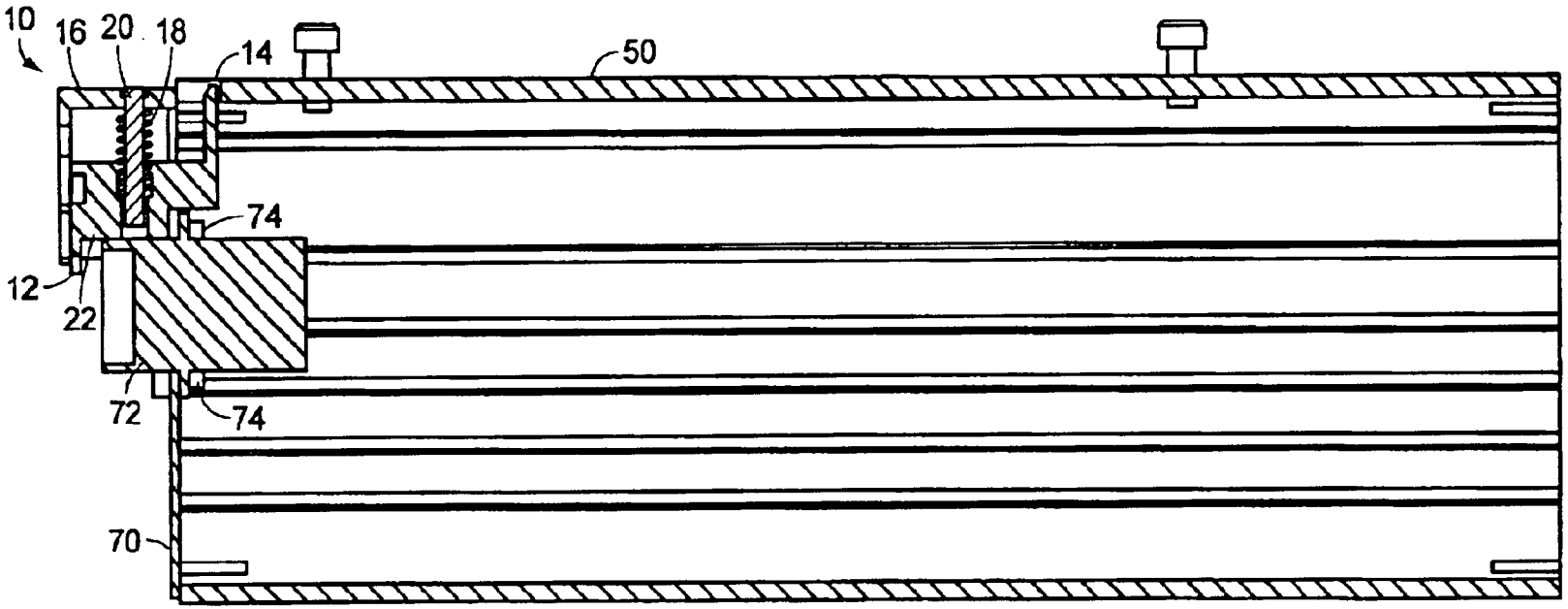
FIG. 6B illustrates a cross-sectional view of a securing mechanism attached to a module.

FIG. 6B illustrates a cross-sectional view of the securing mechanism 10 mounted to a faceplate 70 on module 50. The securing mechanism 10 is shown in a neutral position.

Figure 7B:
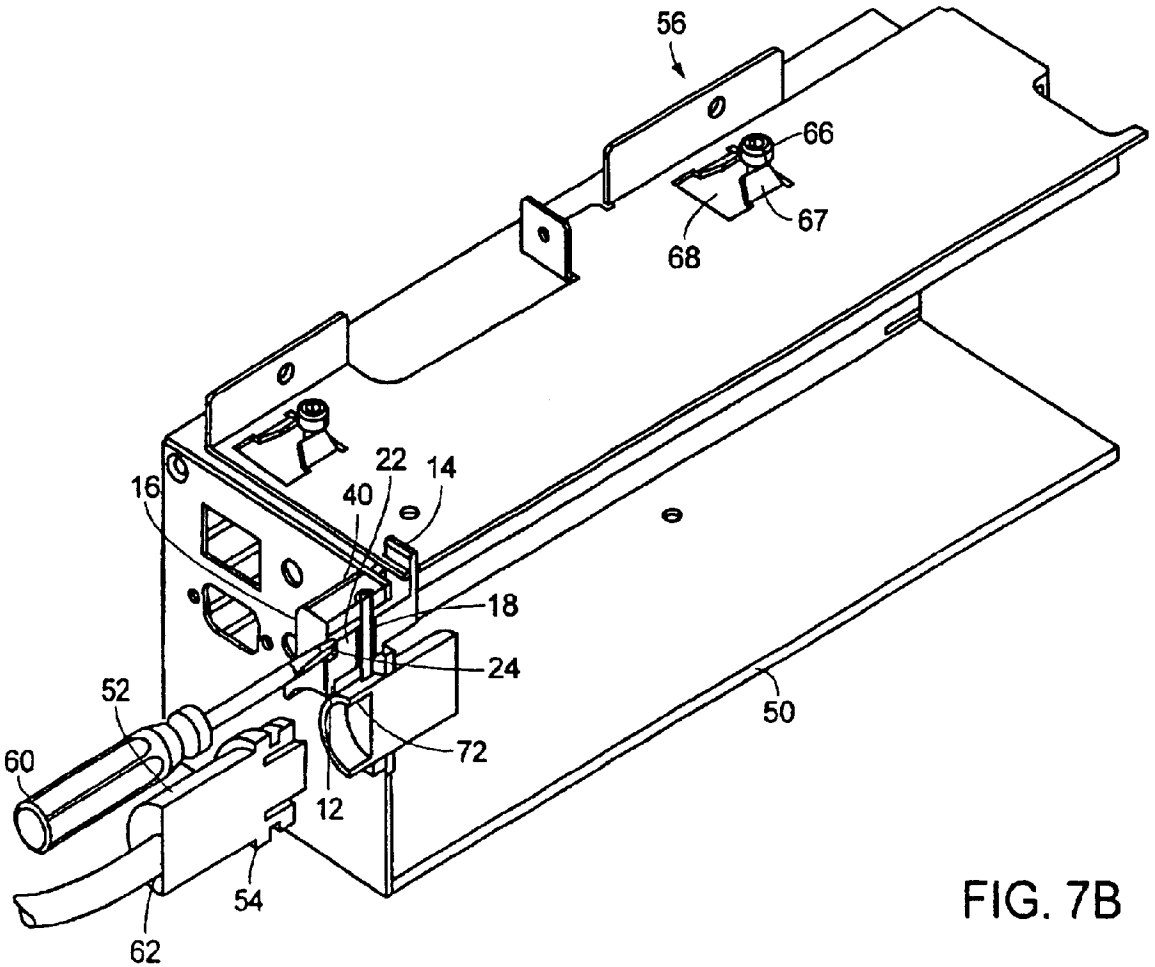
FIG. 7B illustrates a sectional view of FIG. 7A.

FIGS. 7A and 7B illustrate the positioning of the latch 22 within the housing 16 of the securing mechanism 10 such that the connector 52 having cable 62 engages with the securing mechanism 10 and a module 50 engages with a housing support 56. To connect the module 50 to the housing support 56, the module 50 is placed in proximity to the housing support 56. The module 50 can include fasteners or connectors 66 which are mateable with housing support apertures 68 having housing support tabs 67. To engage the module 50 with the housing support 56, the fasteners 66 are placed within the housing support apertures 68. Sliding of the module 50 within the housing support 56 causes the fasteners 66 of the module 50 to slide back over the housing support tabs 67. The fasteners 66 and the module 50 are supported within the housing support 56 by the housing support tabs 67.

Once the module 50 is in proximity to the housing support 56, a user then inserts a tool 60 within the tool guide aperture 30 of the housing 16 and engages the position adjustment mechanism 24. The user moves the latch 22 towards a top surface 40 of the housing 16. Such movement positions the connector latch protrusion 12 away from the mating connector 72, thereby allowing the connector 52 to engage the mating connector 72. When the user moves the latch 22 towards the top surface 40 of the housing 16, the module latch protrusion 14 engages the housing support 56. The user can secure or lock the latch 22 in a raised position by engaging the tool 60 with the tool securing mechanism 38 located on the housing 16. Such locking prevents the biasing mechanism 18 from expanding and forcing the latch 22 away from the top surface 40 of the housing 16 thereby causing the connector protrusion 12 to block mating connector 72. The tool securing mechanism 38 also secures the tool in a single position to allow the user to have both hands available to engage the connector 52 to the mating connector 72 of the module 50.

Preferably, the connector 52 includes a flange 54. Once the user has engaged the connector 52 to the mating connector 72, the user removes the tool 60 from the tool securing mechanism 38 thereby allowing the latch 22 to be positioned away from the top surface 40 of the housing 16. The connector latch protrusion 12 engages the flange 54 on the connector 52, thereby preventing the removal of the connector 52 from the mating connector 72 without the use of the tool 60. Where the connector 52 does not include a flange 54, the connector latch protrusion 12 can engage a portion of the connector to secure the connector 52 to the module 50. The module latch protrusion 14 remains engaged with the housing support 56 when the latch 22 is positioned away from the top surface 40 of the housing 16. Engagement of the module latch protrusion 14 with the housing support 56 prevents the module 50 from sliding forward in the housing support 56 beyond the support tabs 67.

Figure 8B:
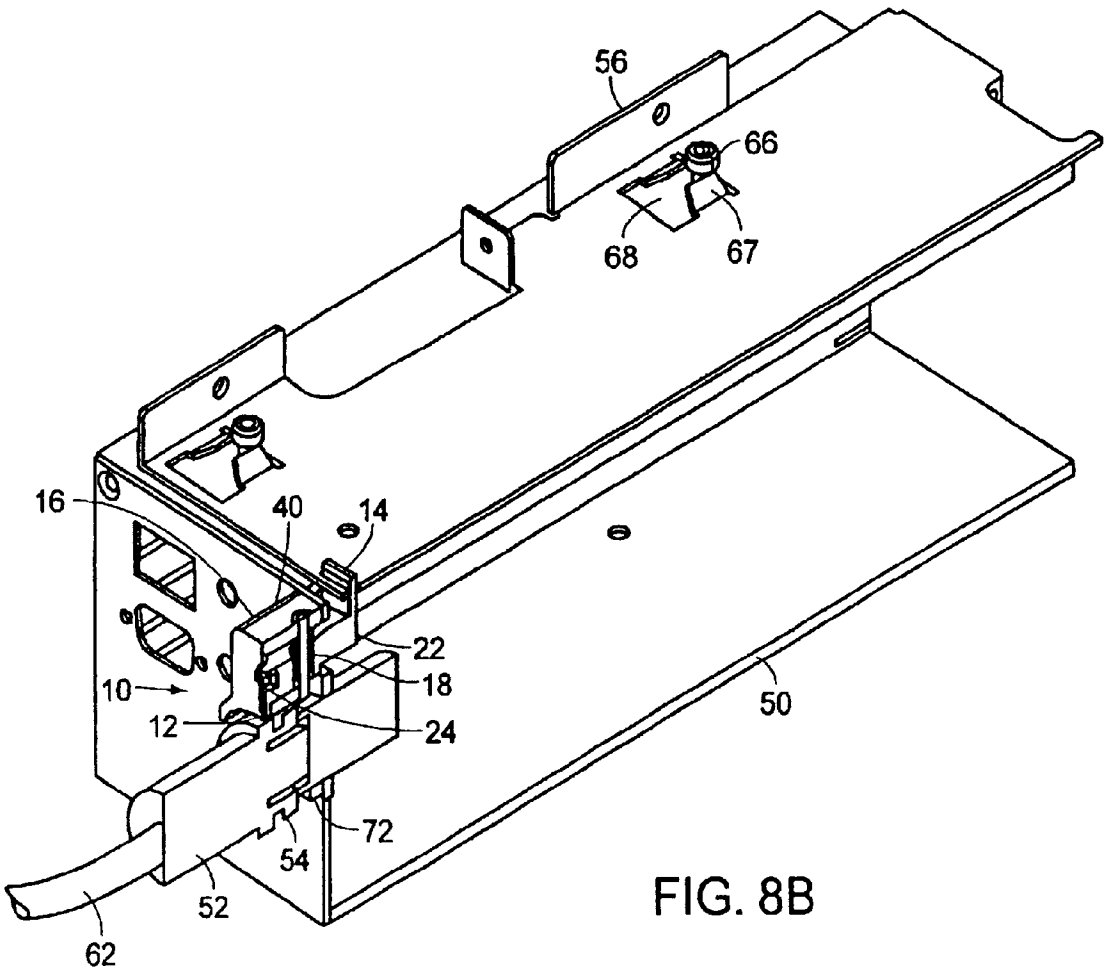
FIG. 8B illustrates a sectional view of FIG. 8A.

FIGS. 8A and 8B show a connector 52 engaged with a module 50 and the module 50 secured to a housing support 56, using securing mechanism 10. By using the securing mechanism 10, when the connector 52 is secured to the module 50, the module 50 is secured to the housing support 56. Therefore, the module 50 cannot be removed from the housing support 56 without removal of the connector 52 from the securing mechanism 10. Furthermore, the connector 52 cannot be removed from the module 50 without the use of a tool to engage position adjustment mechanism 24 located on the latch 22.

To remove the connector 52 from the module 50, a user engages the position adjustment mechanism 24 with a tool and positions the latch 22 toward a top surface 40 of the housing 16. The connector 52 is then removed from the mating connector 72. Lowering the position adjustment mechanism 24 disengages the module latch protrusion 14 from the housing support 56, allowing removal of the module 50 from the support 56. The module 50 can then slide forward within the housing support 56, causing fasteners 66 to slide forward on housing support tabs 67. When the fasteners 66 engage the housing support apertures 68, the module 50 can be removed from the housing support 56.

Figure 9:
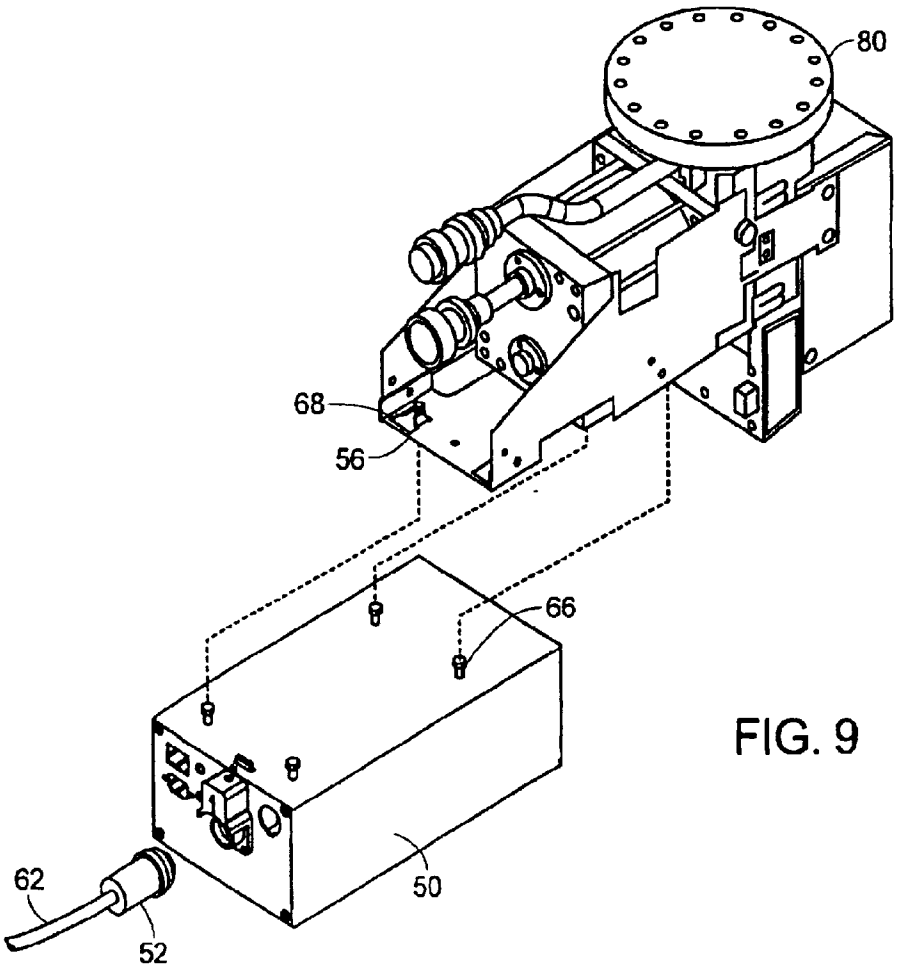
FIGS. 9 through 11 illustrate a module, pump and securing mechanism.
Figure 10:
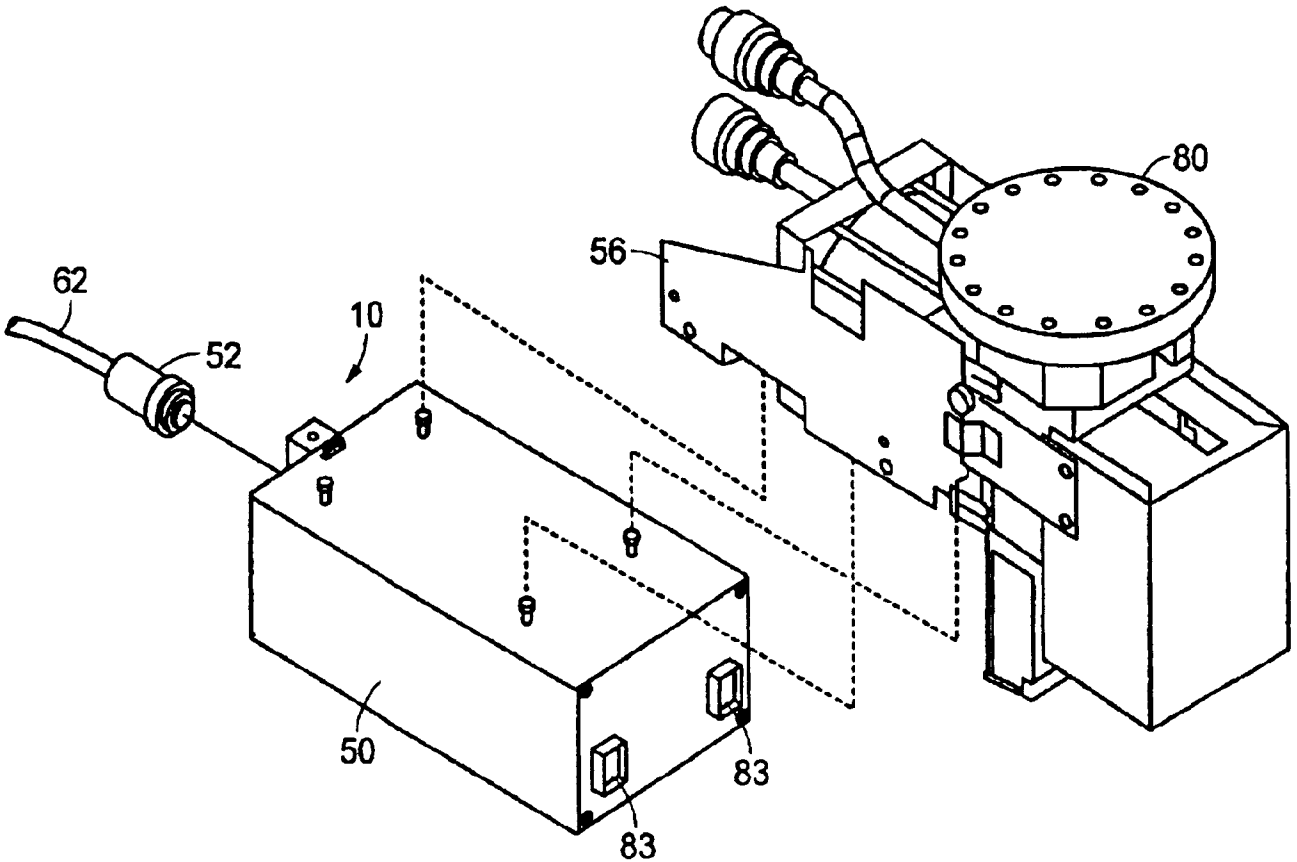
Figure 11:
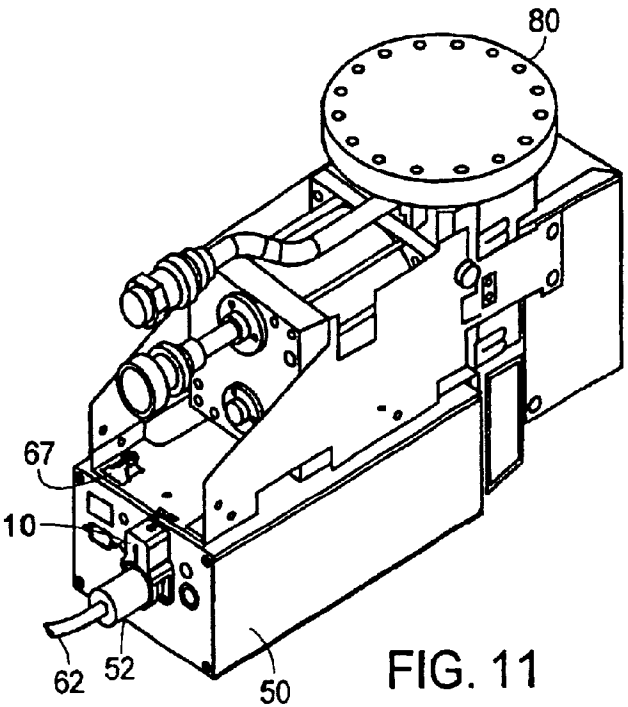

FIGS. 9 through 11 illustrate the securing mechanism 10 used in conjunction with a pump assembly 80, such as that used in cryogenic applications. FIGS. 9 and 10 show front perspective and rear perspective views, respectively of a module 50 mounting to a pump assembly 80. The pump assembly 80 includes a housing support 56 as part of the pump assembly 80. The housing support 56 includes housing support apertures 68 and housing support tabs 67. The module 50 includes module connector jacks 83, such as electrical connectors, that engage with the pump assembly 80. The connector jacks 83 can be used to deliver power from a connector 52 through the module 50 and into the pump assembly 80.

To attach the module 50 to the pump assembly 80, fasteners 66 on the module 50 mate with housing support apertures 68 on the housing support 56. Sliding the module 50 within the housing support 56 causes the fasteners 66 of the module 50 to slide back over the housing support tabs 67. The fasteners 66 and the module 50 are supported within the housing support 56 on the pump assembly 80 by the housing support tabs 67. A tool is used in conjunction with the securing mechanism 10 to move the position adjustment mechanism 24 within the housing 16 such that a connector 52 engages the module 50 and the module 50 engages the housing support 56 of the pump assembly 80. By using the securing mechanism 10, the module 50 cannot be removed from the pump 80 unless the connector 52 is first removed from the module 50.

Figure 12:
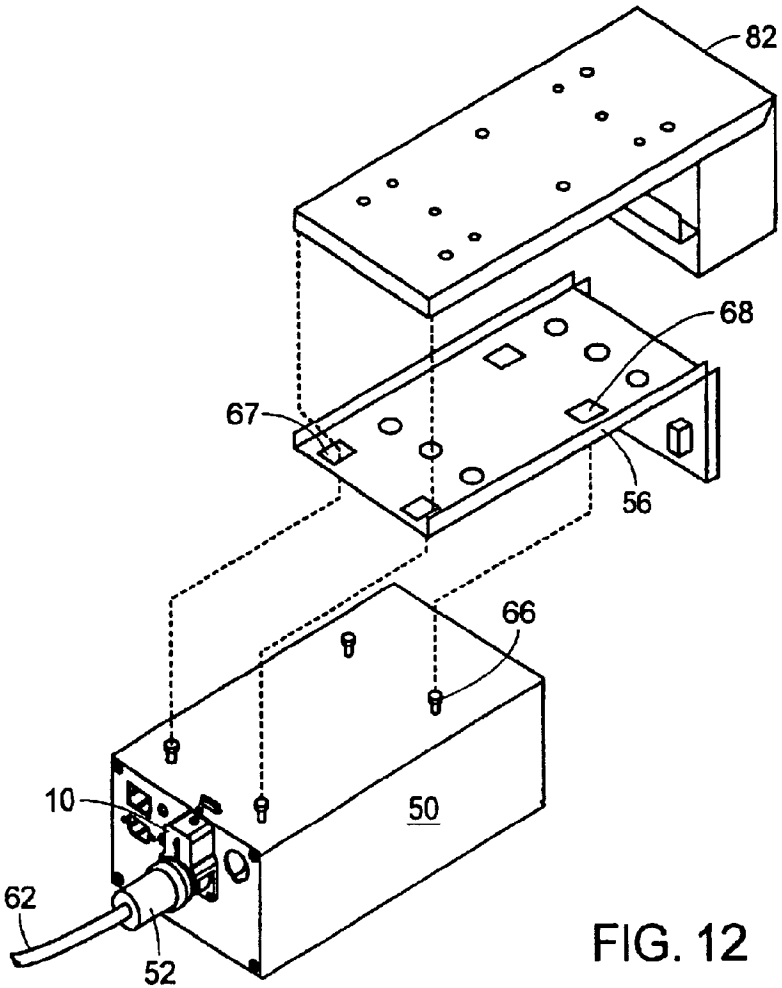
FIGS. 12 through 15 illustrate a securing mechanism and a remote docking station.

FIGS. 12 through 15 illustrate the securing mechanism 10 used in conjunction with a remote docking station (RDS) 82. Because of space limitations with the aforementioned pump assembly 80, modules 50 are sometimes required to be located away from the pump 80. The RDS 82 allows for remote placement and securing of the module 50. FIG. 12 illustrates a housing support 56 forming a portion of the RDS 82. The housing support 56 and RDS 82 are connected to form a single component. The housing support 56 includes housing support apertures 68 and housing support tabs 67.

Figure 14:
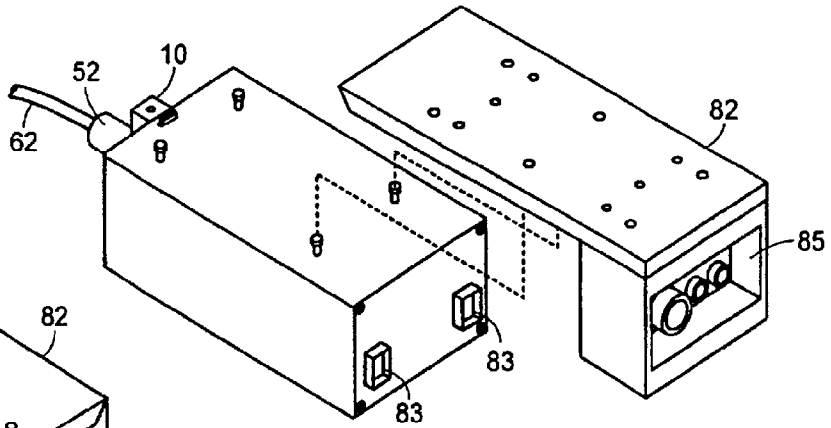
Figure 13:
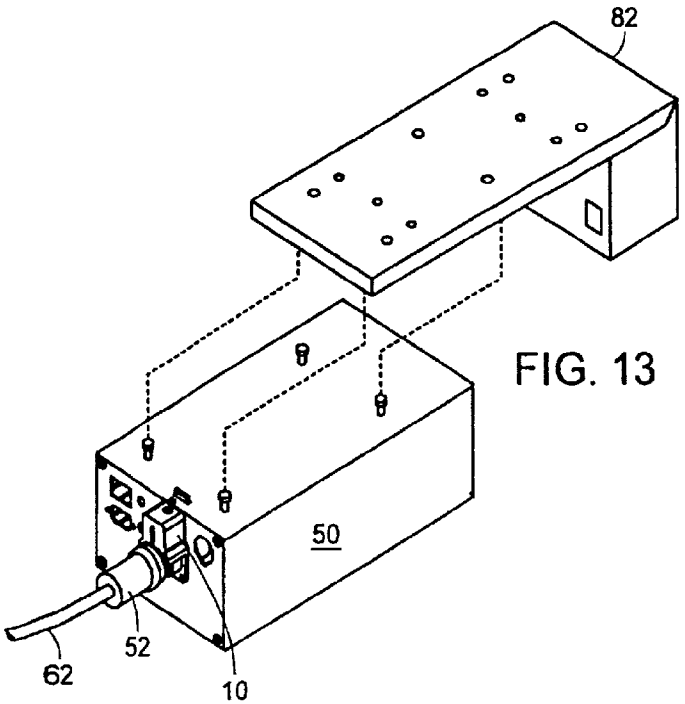
Figure 16:
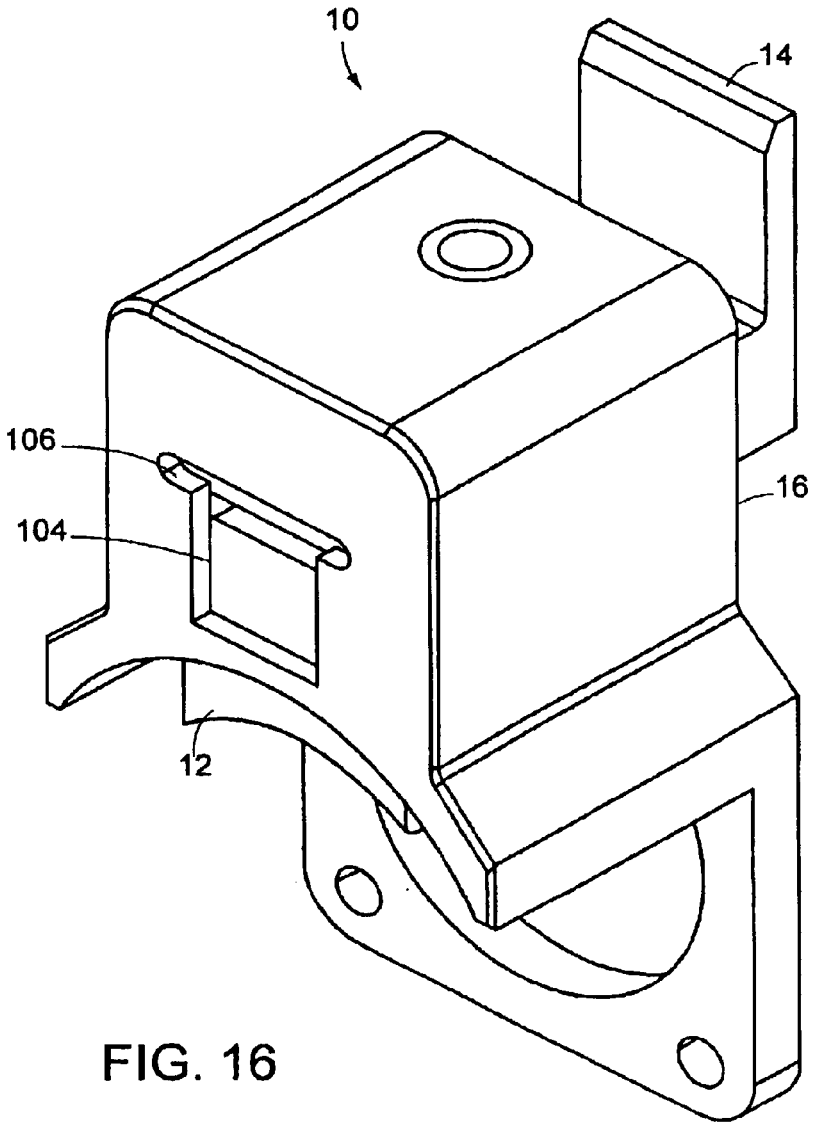
FIG. 16 illustrates an isometric view of a securing mechanism having an alternate tool guide aperture and tool securing mechanism.
Figure 17:
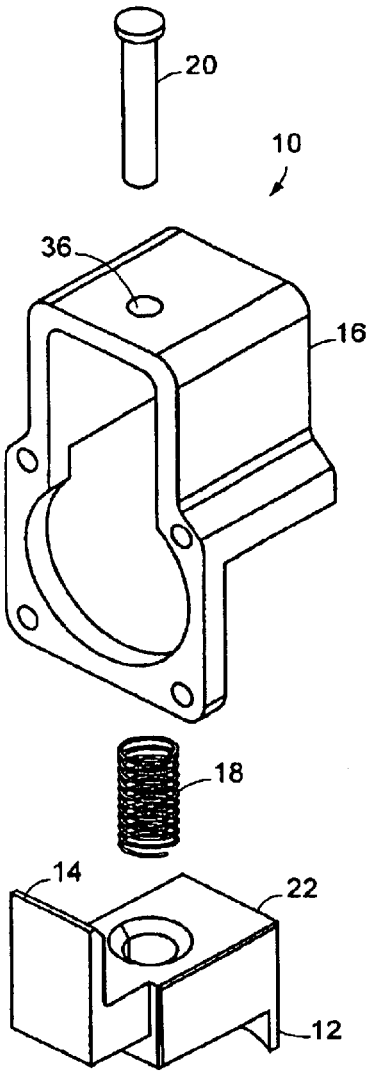
FIGS. 17 and 18 illustrate an exploded isometric rear and front view, respectively, of the securing mechanism of FIG. 16.
Figure 18:
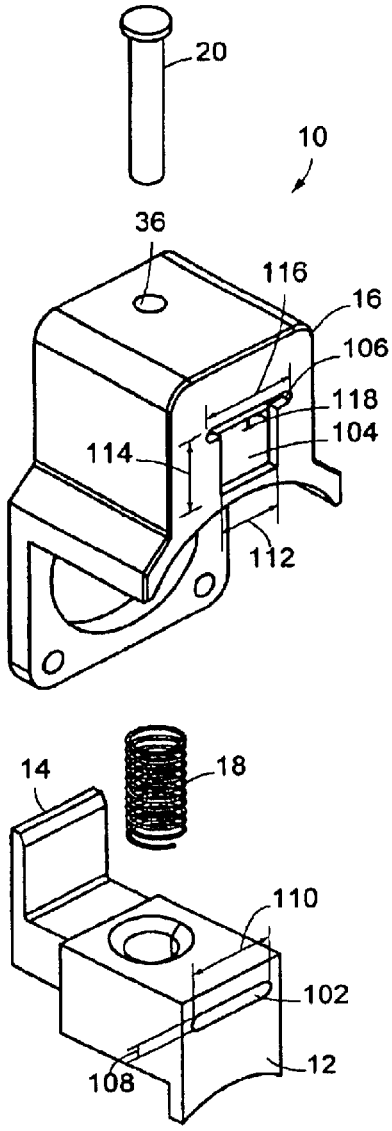
Figure 19:
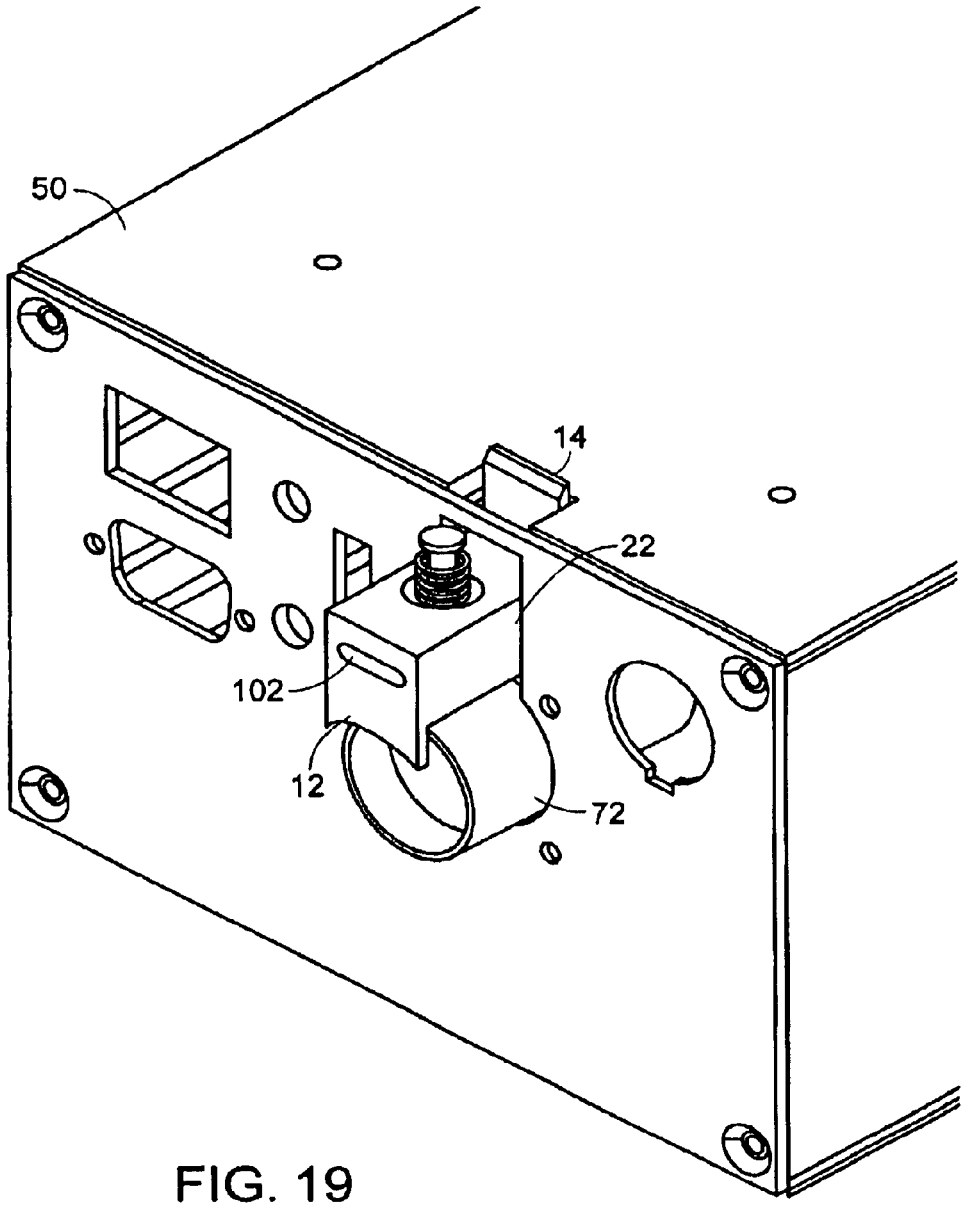
FIG. 19 illustrates the latch of the securing mechanism of FIG. 16 in relation to a module.

FIGS. 13 and 14 illustrate a front and rear perspective view, respectfully, of a module 50 attaching to the RDS 82. The module 50 includes module connector jacks 83, such as electrical connectors, that engage with the RDS 82. The connector jacks 83 can be used to deliver power from a connector 52 through the module 50 and into the RDS 82. The RDS also includes RDS connector jacks 85 that can be used to electrically attach the RDS to a cryopump, for example.

Figure 15:
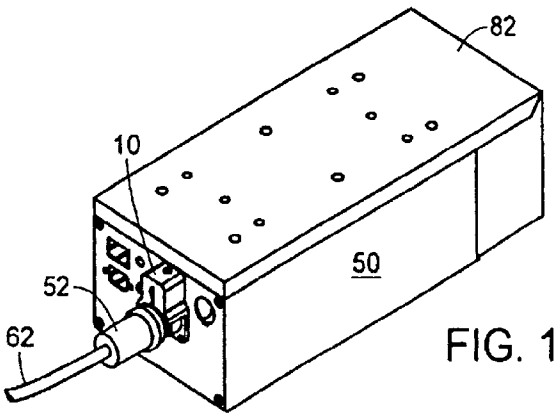

To attach the module 50 to the RDS 82, fasteners 66 on the module 50 mate with housing support apertures 68 on the housing support 56. Sliding the module 50 within the housing support 56 causes the fasteners 66 of the module 50 to slide back over the housing support tabs 67. The fasteners 66 and the module 50 are supported within the housing support 56 on the RDS 82 by the housing support tabs 67. A tool is used in conjunction with the securing mechanism 10 to move the position adjustment mechanism 24 within the housing 16 such that a connector 52 engages the module 50 and the module 50 engages the housing support 56 of the RDS 82. This engagement is shown in FIG. 15. By using the securing mechanism 10 the module 50 cannot be removed from the RDS 82 unless the connector 52 is first removed from the securing mechanism 10.

FIGS. 16 through 21 illustrate a securing mechanism 10 having a preferred embodiment of a position adjustment mechanism 102, tool guide aperture 104 and tool securing mechanism 106. The latch 22 of the securing mechanism 10 includes a position adjustment mechanism 102 that is slot-shaped, having a length 110 of approximately 0.25 inches and a width 108 of approximately 0.0625 inches. The housing 16 of the securing mechanism 10 includes a tool guide aperture 104 and a tool securing mechanism 106 where the tool guide aperture 104 and the tool securing mechanism 106 form a T-shape within the housing 16.

The tool guide aperture 104 is rectangular shaped, having a length 112 of approximately 0.23 inches and a height 114 of approximately 0.235 inches. The aperture 104 allows a user to access the position adjustment mechanism 102 of the latch 22 using a tool having a flat shape, such as a flat head screwdriver, for example.

The tool securing mechanism or slot 106 corresponds to the shape of the tool insertion receptacle 102 and includes a length 116 of approximately 0.44 inches and a width 118 of approximately 0.06 inches. The slot 106 is a transverse slot and allows a user to lock a tool in a stationary position, thereby allowing the user to remove his hands from the tool. The slot 106 also allows the user to secure the latch 22 in a raised position, thereby preventing motion of the latch 22 within the housing 16. To lock the tool within the housing 16, the user first inserts the tool into the tool guide aperture 102 of the housing 16 and engages the position adjustment mechanism 102 of the latch 22. The user raises the latch 22 within the tool guide aperture 102 until the tool is engageable with the slot 106 on the housing 16. The user can then position the tool within the slot 106 by sliding the tool to the right edge or to the left edge within the slot 106. This positioning of the tool within the slot 106 prevents the lowering of the latch 22 and allows the tool to remain in a stationary position, thereby securing the latch 22 and the tool.

Figure 20:
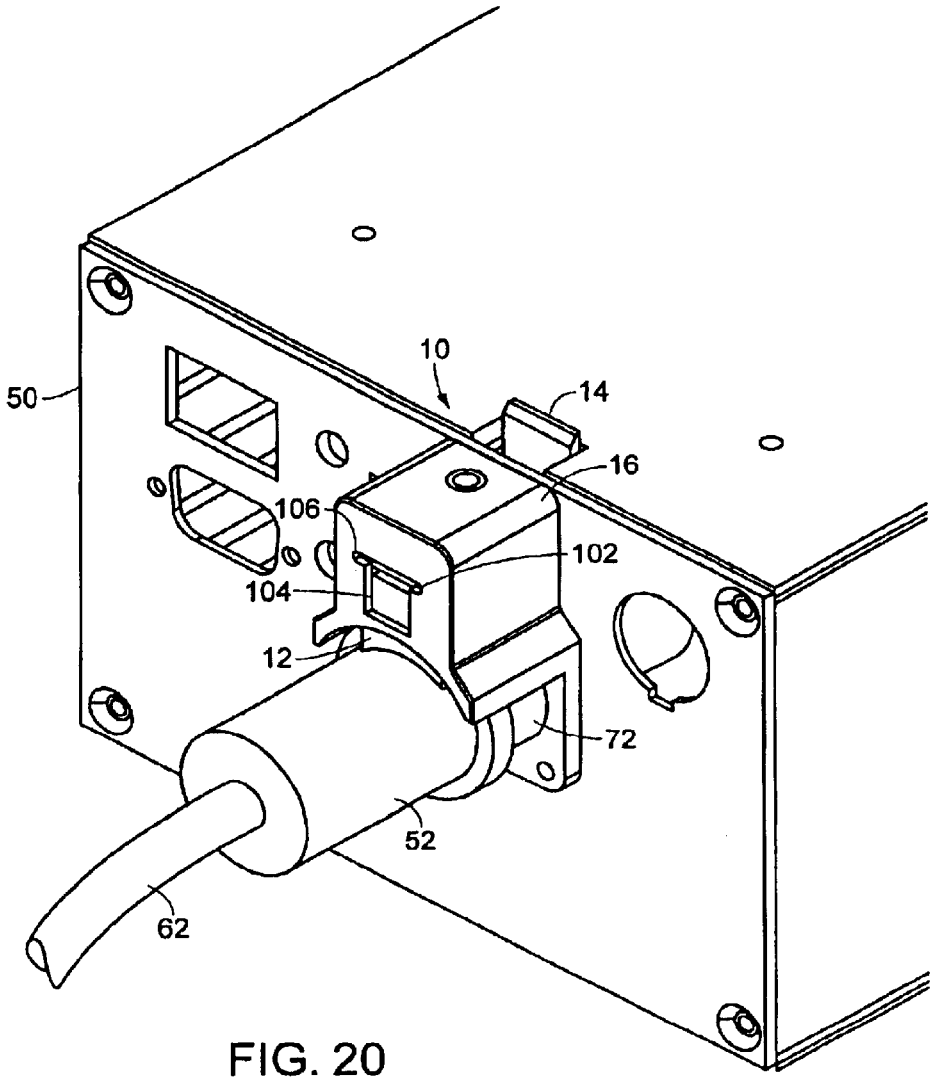
FIG. 20 illustrates a securing mechanism of FIG. 16 securing a connector.
Figure 21:
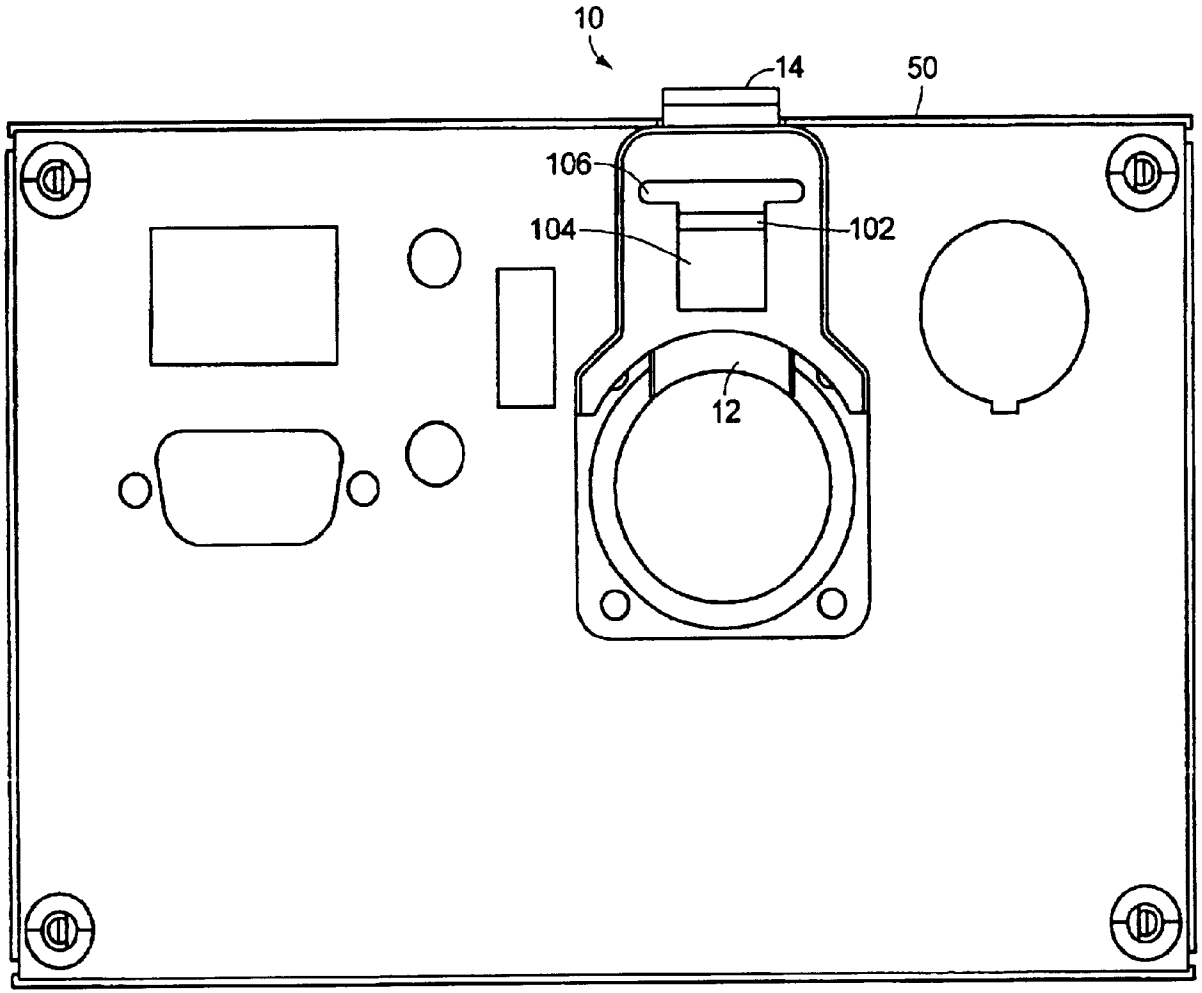
FIG. 21 illustrates a front view of the securing mechanism of FIG. 20.

FIG. 20 illustrates a securing mechanism 10 wherein the connector latch protrusion 12 engages a connector 52 and the module latch portion 14 engages a housing support 56 (not shown). When the connector latch 12 and module latch 14 protrusions engage of the connector 52 and housing support 56 respectively, the tool insertion receptacle 102 is positioned just below the slot 106. As is shown in FIG. 21, with the tool insertion receptacle below the tool securing mechanism, a tool is required to engage the position adjustment mechanism 102 in order to position the latch 22 to remove the connector 52 from the module 50, thereby allowing removal of the module 50 from the housing support 56.

Figure 22B:
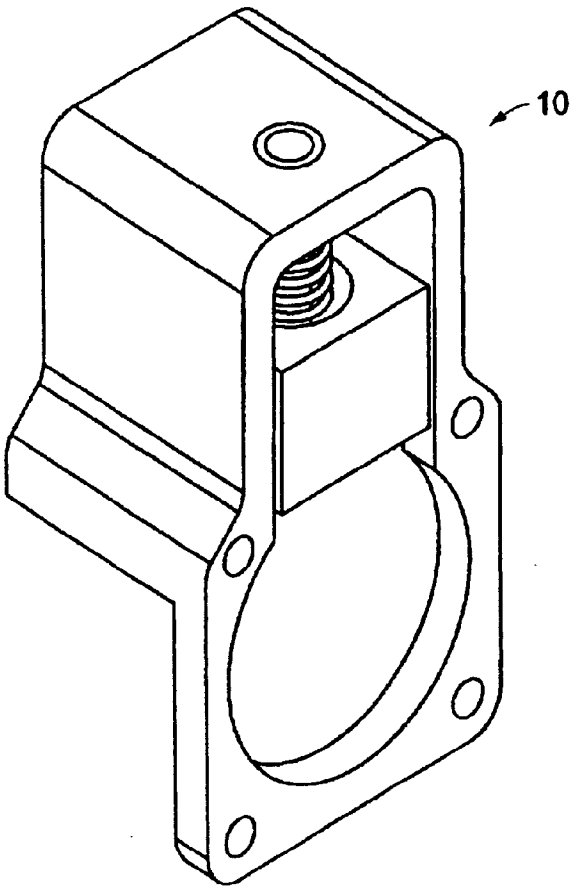
FIGS. 22A and 22B illustrate a securing mechanism having a connector latch protrusion.
Figure 22A:
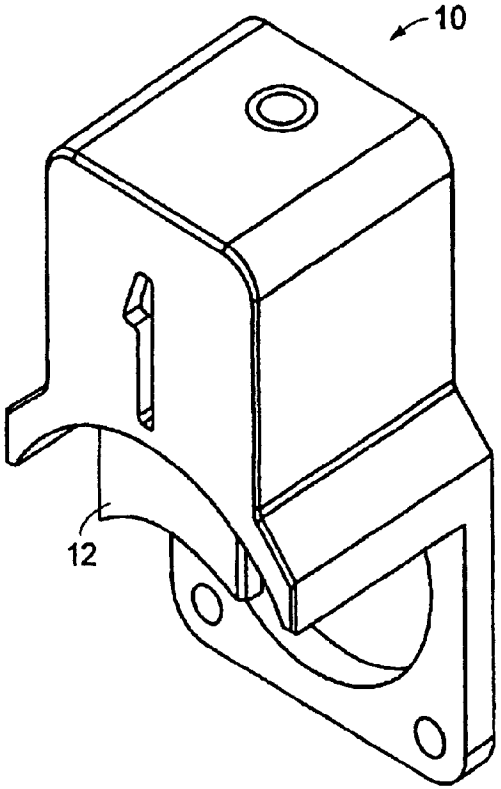

In an alternate embodiment, the securing mechanism 10 includes only a connector latch protrusion 12 as shown in FIGS. 22A and 22B. In this embodiment, the securing mechanism 10 does not secure a module 50 to a housing support 56 when the connector latch protrusion 12 engages a connector 52. The securing mechanism 10 shown in FIGS. 22A and 22B can be used when module security is not required.

Figure 23B:
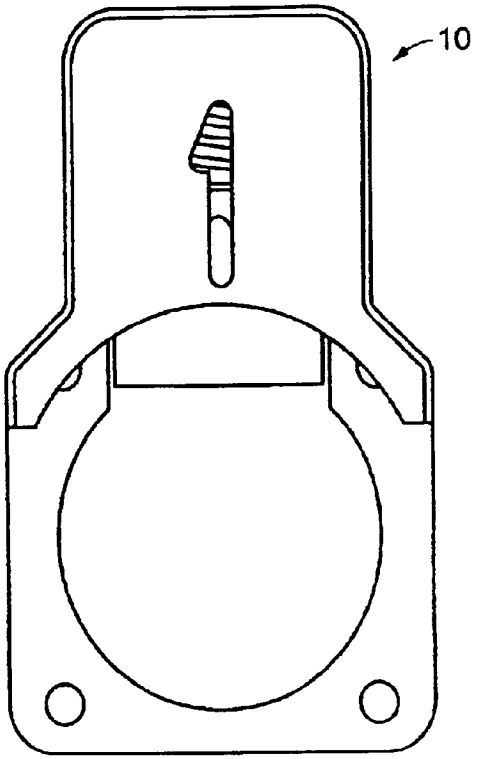
FIGS. 23A and 23B illustrate a securing mechanism having a module latch protrusion.
Figure 23A:
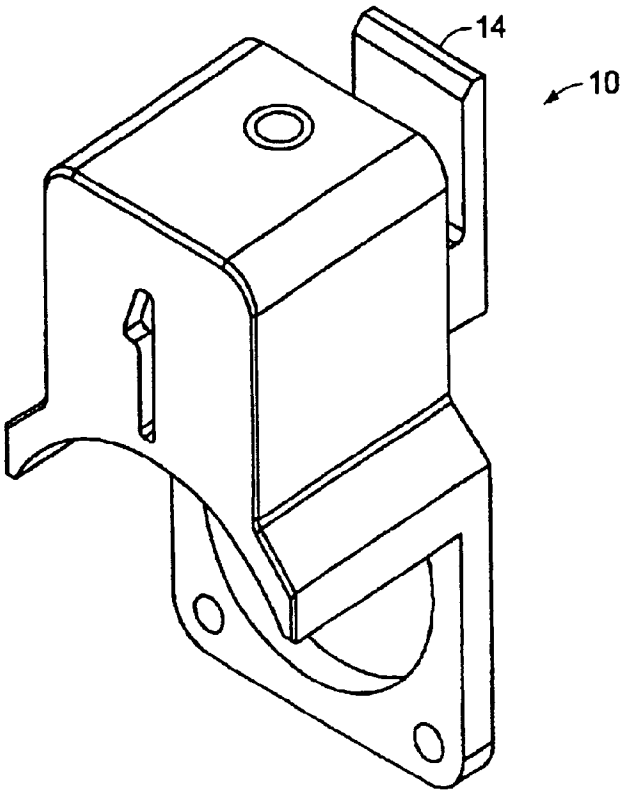

In another embodiment, the securing mechanism 10 includes only a module latch or module latch protrusion 14 as shown in FIGS. 23A and 23B. The module latch protrusion 14 is used to attach a module 50 to a housing support 56. In this embodiment the securing mechanism 10 does not secure a connector 52 to a module 50 when the module latch 14 engages a housing support 56. This securing mechanism can be used when a connector 52 carrying low voltages, generally under 48V, is attached to the module 50. For low voltages, there is no UL requirement to lock the connector or the line to the module 50, thereby allowing for the use of a securing mechanism 10 having only a module latch 14.

Figure 24:
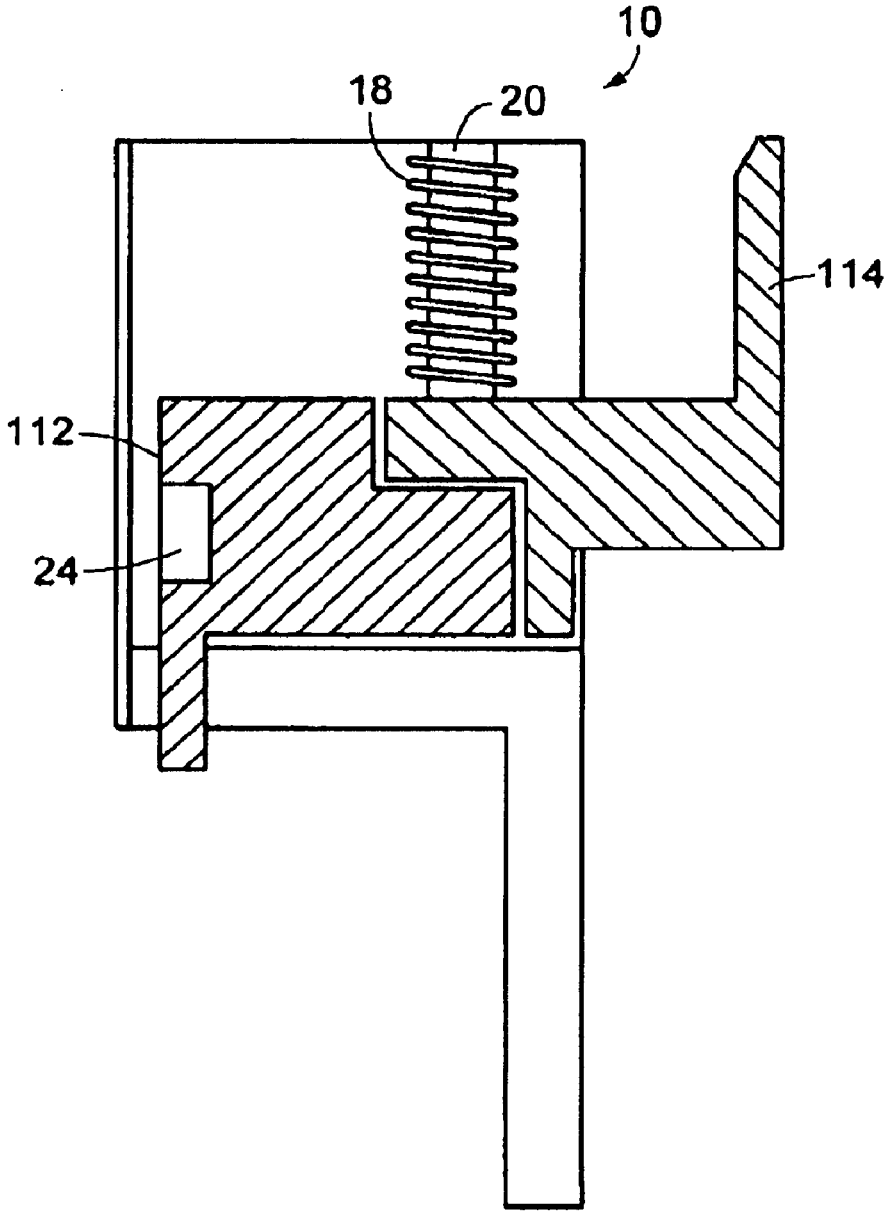
FIG. 24 shows a securing mechanism having a connector latch and a module latch.

While the connector latch protrusion 12 and module latch protrusion 14 are illustrated as being formed as part of a single latch 22, the connector latch protrusion 12 and module latch protrusion 14 can be formed as separate components within the securing mechanism, as shown in FIG. 24. For example, a connector latch 112 and a module latch 114 can be formed in a securing mechanism 10 as two interlocking components whereby motion of the connector latch 112 caused by the position adjustment mechanism 24 controls the motion of the module latch 114.

While this invention has been particularly shown and described with references to preferred embodiments thereof, it will be understood by those skilled in the art that various changes in form and details may be made therein without departing from the scope of the invention encompassed by the appended claims.

What is claimed is:

1. A securing mechanism comprising:

a housing;

a connector latch moveably mounted and substantially enclosed within the housing, the connector latch engageable with a connector to secure the connector, and requiring a tool insertable into the housing to adjust the positioning of the connector latch in order to engage or disengage the connector latch from the connector; and a module latch moveably mounted within the housing, the module latch engageable with a housing support, engagement of the connector latch with the connector causing the module latch to engage the housing support.

2. The securing mechanism of claim 1 wherein the connector latch and module latch comprise a single latch.

3. The securing mechanism of claim 1 wherein the connector latch is formed as a first latch component and the module latch is formed as a second latch component, the first latch component matable with the second latch component.

4. The securing mechanism of claim 1 wherein the connector latch or the module latch includes a low friction surface wherein the low friction surface minimizes binding f the latch within the housing.

5. The securing mechanism of claim 1 wherein the connector latch comprises a position adjustment mechanism accessible through a slot in the housing by a tool, such that the position adjustment mechanism controls movement of the connector latch.

6. The securing mechanism of claim 1 further comprising a biasing mechanism wherein the biasing mechanism positions the connector latch and the module latch within the housing.

7. The securing mechanism of claim 1 further comprising a tool securing mechanism attached to the housing, the tool securing mechanism preventing motion of the latch within the housing.

8. The securing mechanism of claim 7 wherein the tool securing mechanism comprises a transverse slot within the housing.

9. A securing mechanism comprising:

a housing; and a latch mounted within the housing, the latch having a connector latch protrusion, engageable with a connector, and a module latch protrusion, engageable with a housing support, engagement of the connector latch protrusion with the connector securing the connector to the module and causing the module latch protrusion to engage the housing support.

10. The securing mechanism of claim 9 wherein the latch includes a low friction surface wherein the low friction surface minimizes binding of the latch within the housing.

11. The securing mechanism of claim 9 wherein the latch comprises a position adjustment mechanism accessible though a slot in the housing by a tool, such that the position adjustment mechanism controls movement of the latch.

12. The securing mechanism of claim 9 further comprising a biasing mechanism wherein the biasing mechanism positions the latch within the housing.

13. The securing mechanism of claim 9 further comprising a tool securing mechanism attached to the housing, the tool securing mechanism preventing motion of the latch within the housing.

14. The securing mechanism of claim 13 wherein the tool securing mechanism comprises a transverse slot within the housing.

15. A module comprising:

a housing enclosing electronic components;

a securing mechanism mounted to the housing, the securing mechanism having a connector latch moveably mounted and engageable with a connector and a module latch moveably mounted and engageable with a housing support, engagement of the connector latch with a connector securing the connector to the module and causing the module latch to engage the housing support.

16. The module of claim 15 wherein the connector latch further comprises a position adjustment mechanism wherein the position adjustment mechanism is engageable with a tool through a slot in the mechanism housing.

17. The module of claim 15 further comprising a biasing mechanism wherein the biasing mechanism positions the connector latch and the module latch within the mechanism housing.

18. The module of claim 15 wherein the connector latch or the module latch includes a low friction surface wherein the low friction surface minimizes binding of the latch within the housing.

19. The module of claim 15 further comprising a tool securing mechanism attached to the housing, the tool securing mechanism preventing motion of the latch within the housing.

20. The module of claim 19 wherein the tool securing mechanism comprises a transverse slot within the housing.

21. A method for securing a module to a bracket comprising:

providing a module having a mating connector and a securing mechanism, the securing mechanism having a latch having a connector latch protrusion and a module latch protrusion;

mounting the module to a housing support;

raising the position of the latch to allow a connector to engage the mating connector to secure the connector to the module and to cause the module latch to engage the housing support;

releasing the latch to allow the connector latch protrusion to engage the connector and causing the module latch to remain engaged with the housing support.

22. The method of claim 21 further comprising:

providing a latch positioning tool for adjustment of the position of the latch; and using the tool to adjust the position of the latch.

23. The method of claim 21 further comprising:

providing a tool securing mechanism; and using the tool securing mechanism to prevent motion of the latch once the latch is in a raised position.

24. A method for removing a module from a housing support comprising:

providing a module attached to a housing support, the module having a mating connector, a connector engaged with the mating connector and a securing mechanism having a latch with a connector latch protrusion and a module latch protrusion, the connector latch protrusion engaged with the connector for securing the connector to the module and the module latch protrusion engaged with the housing support;

adjusting the position of the latch to disengage the connector latch protrusion from the connector;

removing the connector from the module;

releasing the latch to disengage the module latch protrusion from the housing support; and removing the module from the housing support.

25. The method of claim 24 further comprising:

providing a latch positioning tool for adjustment of the position of the latch; and using the tool to adjust the position of the latch.

26. The method of claim 24 further comprising:

providing a tool securing mechanism; and using the tool securing mechanism to prevent motion of the latch once the latch is in a raised position.

27. A securing mechanism comprising:

a housing;

a connector latch moveably mounted within the housing, the connector latch engageable with a connector to secure the connector;

a position adjustment mechanism attached to the connector latch, the position adjustment mechanism controlling movement of the connector latch; and a slot formed within the housing, the slot securing a tool to the housing of the securing mechanism.

28. The securing mechanism of claim 27 further comprising a biasing mechanism wherein the biasing mechanism positions the connector latch within the housing.

29. The securing mechanism of claim 27 wherein the connector latch or the module latch includes a low friction surface wherein the low friction surface minimizes binding of the connector latch within the housing.

30. The module of claim 27 wherein the slot is a transverse slot.

31. The module of claim 15 wherein the housing further comprises a module housing that encloses the electronic components, and a mechanism housing mounted to the module housing that encloses the securing mechanism.

32. A securing mechanism comprising:

a housing;

a connector latch moveably mounted within the housing, the connector latch engageable with a connector to secure the connector;

a position adjustment mechanism attached to the connector latch, the position adjustment mechanism controlling movement of the connector latch; and a slot formed within the housing, the slot providing access to the position adjustment mechanism within the housing of the securing mechanism by a tool.

33. The securing mechanism of claim 32 wherein the slot is a vertical slot.

34. The securing mechanism of claim 32 further comprising a biasing mechanism wherein the biasing mechanism positions the connector latch within the housing.

35. The securing mechanism of claim 32 wherein the connector latch or the module latch includes a low friction surface wherein the low friction surface minimizes binding of the connector latch within the housing.

36. A securing mechanism comprising:

a housing;

a connector latch moveably mounted within the housing, the connector latch engageable with a connector to secure the connector; and a module latch moveably mounted within the housing, the module latch engageable with a housing support, engagement of the connector latch with the connector causing the module latch to engage the housing support; and a tool securing mechanism attached to the housing, the tool securing mechanism preventing motion of the latch within the housing.

37. The securing mechanism of claim 36 wherein the tool securing mechanism comprises a transverse slot within the housing.

38. A securing mechanism comprising:

a housing;

a latch mounted within the housing, the latch having a connector latch protrusion, engageable with a connector, and a module latch protrusion, engageable with a housing support, engagement of the connector latch protrusion with the connector causing the module latch protrusion to engage the housing support; and a tool securing mechanism attached to the housing, the tool securing mechanism preventing motion of the latch within the housing.

39. The securing mechanism of claim 38 wherein the tool securing mechanism comprises a transverse slot within the housing.

40. A module comprising:

a module housing enclosing electronic components;

a securing mechanism mounted to the module housing, the securing mechanism having a housing, connector latch moveably mounted to the housing and engageable with a connector and a module latch moveably mounted to the housing and engageable with a housing support, engagement of the connector latch with a connector causing the module latch to engage the housing support; and a tool securing mechanism attached to the housing, the tool securing mechanism preventing motion of the latch within the housing.

41. The module of claim 40 wherein the tool securing mechanism comprises a transverse slot within the housing.

42. A method for securing a module to a bracket comprising:

providing a module having a mating connector and a securing mechanism, the securing mechanism having a latch having a connector latch protrusion and a module latch protrusion;

mounting the module to a housing support;

providing a latch positioning tool for adjustment of the position of the latch;

using the tool to adjust the position of the latch;

raising the position of the latch to allow a connector to engage the mating connector and to cause the module latch to engage the housing support; and releasing the latch to allow the connector latch protrusion to engage the connector and causing the module latch to remain engaged with the housing support.

43. A method for securing a module to a bracket comprising:

providing a module having a mating connector and a securing mechanism, the securing mechanism having a latch having a connector latch protrusion and a module latch protrusion;

mounting the module to a housing support;

raising the position of the latch to allow a connector to engage the mating connector and to cause the module latch to engage the housing support;

releasing the latch to allow the connector latch protrusion to engage the connector and causing the module latch to remain engaged with the housing support;

providing a tool securing mechanism; and using the tool securing mechanism to prevent motion of the latch once the latch is in a raised position.

44. A method for removing a module from a housing support comprising:

providing a module attached to a housing support, the module having a mating connector, a connector engaged with the mating connector and a securing mechanism having a latch with a connector latch protrusion and a module latch protrusion, the connector latch protrusion engaged with the connector and the module latch protrusion engaged with the housing support;

providing a latch positioning tool for adjustment of the position of the latch;

using the tool to adjust the position of the latch;

adjusting the position of the latch to disengage the connector latch protrusion from the connector;

removing the connector from the module;

releasing the latch to disengage the module latch protrusion from the housing support; and removing the module from the housing support.

45. A method for removing a module from a housing support comprising:

providing a module attached to a housing support, the module having a mating connector, a connector engaged with the mating connector and a securing mechanism having a latch with a connector latch protrusion and a module latch protrusion, the connector latch protrusion engaged with the connector and the module latch protrusion engaged with the housing support;

providing a tool securing mechanism; and using the tool securing mechanism to prevent motion of the latch once the latch is in a raised position;

adjusting the position of the latch to disengage the connector latch protrusion from the connector;

removing the connector from the module;

releasing the latch to disengage the module latch protrusion from the housing support; and removing the module from the housing support.

* * * * *